United States Patent [19]

Murray

[11] 4,017,989

[45] Apr. 19, 1977

[54] WALL FRAMES WITH INTERLOCKING CLIPS

[75] Inventor: Douglas J. Murray, Portland, Oreg.

[73] Assignee: Dimensional Industries, Inc., Portland, Oreg.

[22] Filed: Dec. 24, 1975

[21] Appl. No.: 644,145

[52] U.S. Cl. ..... 40/152; 40/125 H

[51] Int. Cl.[2] ..... G09F 1/12

[58] Field of Search ..... 40/152, 152.1, 154, 40/156, 158 R, 125 H, 125 R, 125 F, 10 R, 128, 145 R, 152.2

[56] References Cited

UNITED STATES PATENTS

| | | | |
|---|---|---|---|
| 3,428,108 | 2/1969 | Singer | 40/125 R |
| 3,471,959 | 10/1969 | Seger | 40/152 |
| 3,523,382 | 8/1970 | Dreyer | 40/152 |
| 3,673,724 | 7/1972 | Bell et al. | 40/152 |

*Primary Examiner*—John F. Pitrelli
*Attorney, Agent, or Firm*—Clarence A. O'Brien; Harvey B. Jacobson

[57] ABSTRACT

A plurality of mounting frames are provided and have front and rear faces. Each of the frames is defined by at least three elongated interconnected peripheral sides and at least one side of each frame includes a recess formed therein opening outwardly of the rear face of the frame. A connecting member is provided and includes a panel-like body member having front and rear faces. The body member includes at least two spaced projections projecting outwardly from the front face thereof and the frames are disposed in side by side substantially coplanar relation with the sides thereof provided with recesses disposed in juxtaposition. The body member is positioned with its front face closely opposing the rear faces of the frames and with the projections removably frictionally telescoped into adjacent recesses of the frames and the connecting member thereby retaining the frames against separation. The frames may be of the same or different shape and may be of different sizes. Further, each side of each frame may include a plurality of longitudinally spaced recesses opening outwardly of the rear face thereof whereby adjacent frames may be secured in adjusted positions relative to each other.

4 Claims, 8 Drawing Figures

WALL FRAMES WITH INTERLOCKING CLIPS

BACKGROUND OF THE INVENTION

Various forms of attaching structures or connecting members have been heretofore provided for securing adjacent frame members in adjusted positions relative to each other. However, most of these attaching structures or connecting members are constructed in a manner whereby they are readily viewable from the front faces of the associated frames. Further, these attaching structures or connecting members which have been previously known have not been constructed so as to enable various adjustments of adjacent frames relative to each other.

Examples of previously known attaching structures or connecting members including some of the operational characteristics of the instant invention are disclosed in U.S. Pat. Nos. 923,394, 2,317,708, 2,616,197, 3,722,122 and 3,783,543.

BRIEF DESCRIPTION OF THE INVENTION

The frame and interlocking clip structure of the instant invention consists of a plurality of mounting frames and one or more connecting or mounting members to be utilized between adjacent frames for securing the latter in adjusted position relative to each other. The structure of each of the frames is such to enable the frames to be readily manufactured by molding processes and the connecting members are also constructed so as to be readily moldable. Further, the connecting members, from which a pair of adjacent frames are supported, include structure by which the connecting members themselves may be attached to a suitable wall surface. In the event a single connecting member is utilized between two adjacent frames only a single fastener need be used to secure the connecting member to an associated wall structure and yet the connecting member may be utilized to mount a pair of adjacent frames therefrom. Further, the frame supported from the connecting member may be adjusted relative to the latter in order to enable adjacent frames mounted on a wall to be adjusted in positions relative to each other without requiring a different attachment of the wall.

The main object of this invention is to provide a plurality of mounting frames which may be utilized singly or in groups of adjacent frames and mounting structure therefor whereby each frame may be individually secured to an associated wall structure or a single mounting structure may be utilized in supporting a pair of adjacent frames from the associated wall structure.

Another object of this invention, in accordance with the immediately preceding object, is to provide an apparatus enabling a pair of mounting frames to be supported from a wall structure by means of a suitable mounting assembly and with each of the supported mounting frames being adjustable relative to the mounting structure.

Another object of this invention is to provide an apparatus in accordance with the preceding objects and constructed in a manner whereby the mounting frames and mounting structure may be readily manufactured by molding processes.

A final object of this invention to be specifically enumerated herein is to provide an assemblage in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
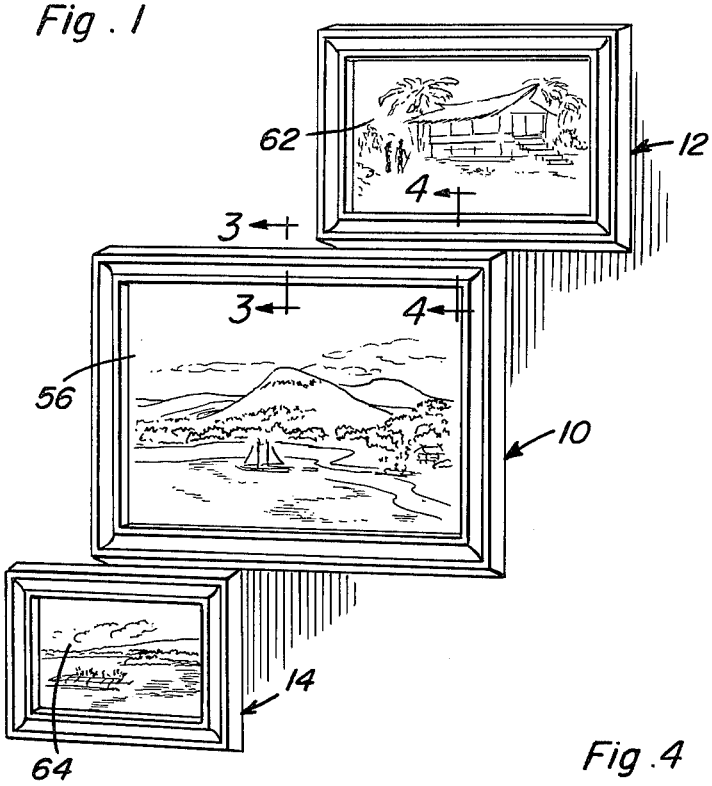
FIG. 1 is an elevational view illustrating three mounting frames (picture) constructed in accordance with the present invention and supported from an associated wall structure in adjusted positions relative to each other by means of mounting structure also constructed in accordance with the present invention.

Referring now more specifically to FIG. 1, the numerals 10, 12 and 14 generally designate three mounting frames (picture) constructed in accordance with the present invention.

Figure 3:
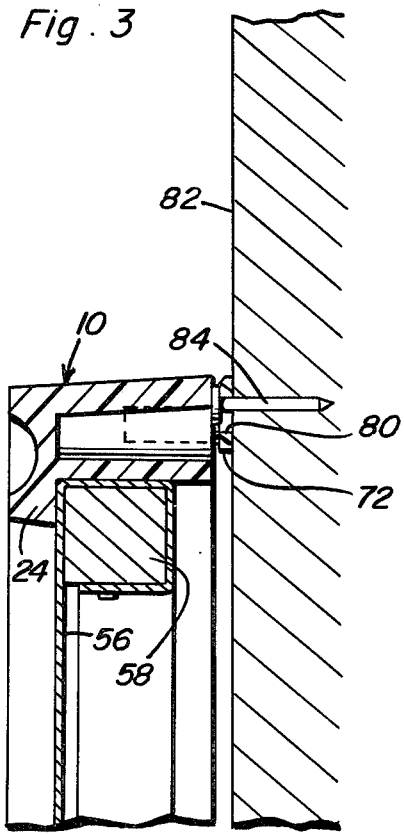
FIG. 3 is an enlarged fragmentary vertical sectional view taken substantially upon the plane indicated by the section line 3—3 of FIG. 1.
Figure 4:
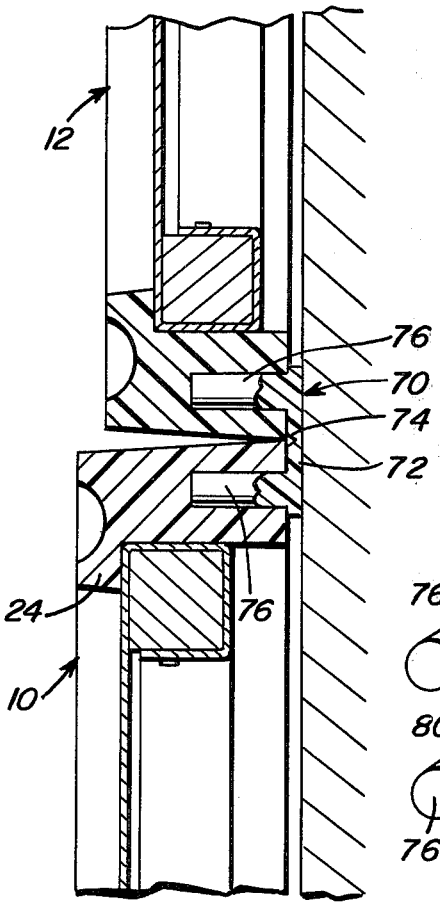
FIG. 4 is an enlarged fragmentary vertical sectional view taken substantially upon the plane indicated by the section line 4—4 of FIG. 1.
Figure 6:
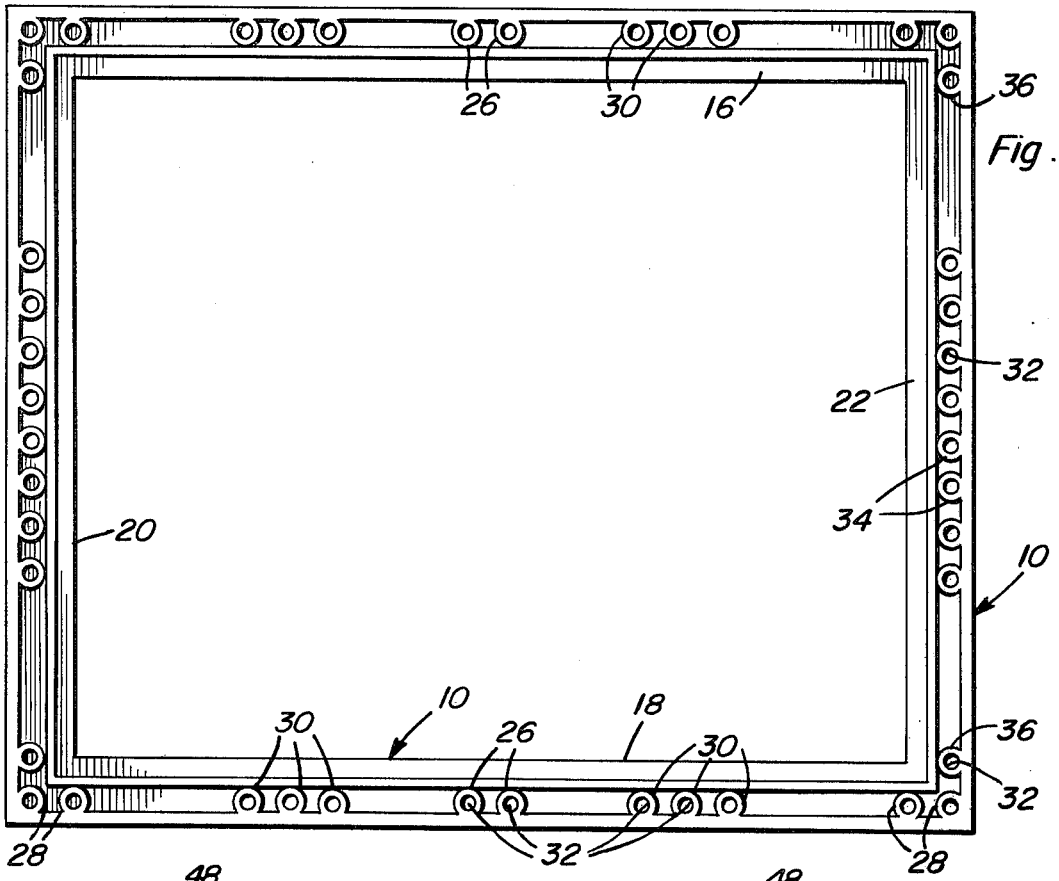
FIG. 6 is a rear elevational view of the largest frame illustrated in FIG. 1.
Figure 7:
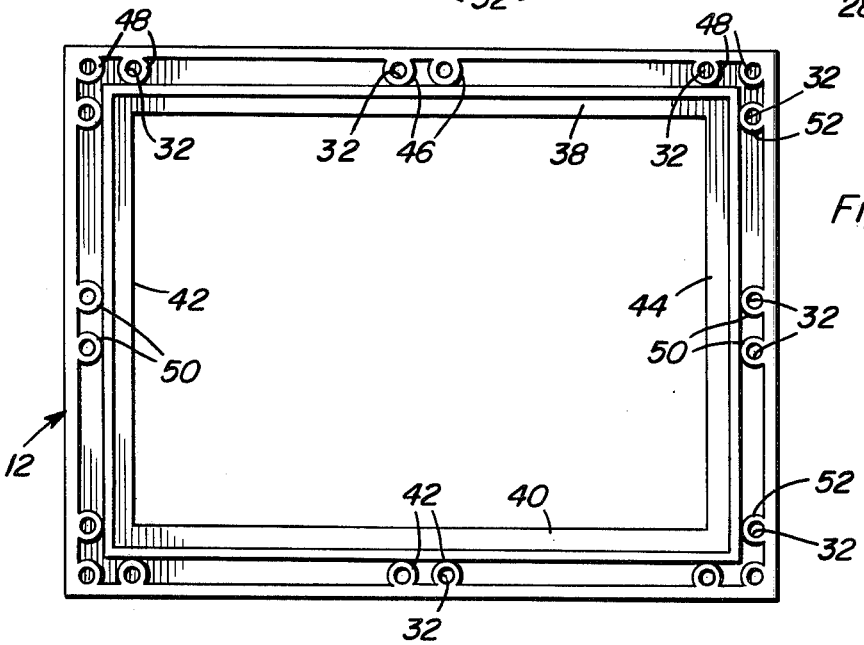
FIG. 7 is a rear elevational view of the intermediate size frame illustrated in FIG. 1.
Figure 8:
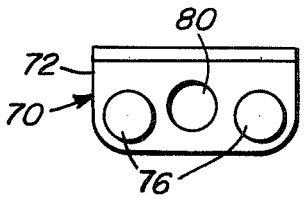
FIG. 8 is an elevational view of one half of one of the mounting structures illustrated in FIG. 5.

As may best be seen from FIGS. 3, 4 and 6 of the drawings, the frame 10 comprises a rectangular frame including upper and lower horizontal members 16 and 18 and opposite side upstanding members 20 and 22 extending between and interconnecting corresponding ends of the members 16 and 18.

Each of the members 16, 18, 20 and 22 comprises a rearwardly opening channel member including an inwardly projecting flange 24 extending along its inner surface. The frames 10, 12 and 14 include front and rear faces and each of the frames is similarly constructed with the flanges 24 forming inward extensions of the outer faces of the frames 10, 12 and 14.

Each of the horizontal members 16 and 18 of the frame 10 includes a central pair of bosses 26 disposed between and interconnecting the corresponding flanges of the channel-shaped horizontal members 16 and 18, pairs of opposite end bosses 28 and a set of three bosses 30 disposed between each pair of adjacent bosses 26 and 28. Each of the bosses 26, 28 and 30 defines an outwardly opening cylindrical recess or blind bore 32 and each member 20 and 22 of the frame 10 includes a set of eight longitudinally spaced bosses 34 and a pair of opposite end bosses 36, the bosses 34 and 36 also defining cylindrical recesses or blind bores 32.

The frame 12 includes upper and lower horizontal members 38 and 40 corresponding to the members 16 and 18 and upstanding members 42 and 44 corresponding to the members 20 and 22. The members 38 and 40 include a central pair of longitudinally spaced bosses 46 corresponding to the bosses 26 and defining cylindrical recesses or bores 32 and opposite end bosses 48 defining similar recesses or blind bores 32. Further, the members 42 and 44 of the frame 12 include a central pair of longitudinally spaced bosses 50 defining cylindrical recesses or blind bores 32 and also opposite end bosses 52 defining cylindrical recesses or blind bores 32. Finally, the frame 14 is constructed in substantially the same manner as the frame 12, except that the horizontal and vertical members of the frame 14 corresponding to the horizontal members 38 and 40 and the vertical members 42 and 44 are slightly shorter.

The frames 12 and 14 include flanges corresponding to the flanges 24 on the inner marginal portions of the members thereof corresponding to the members 16, 18, 20 and 22 and a suitable painting 56 mounted on a frame 58 is mounted within the frame 10 from the rear side thereof against the flanges 24 and the frames 12 and 14 have similar paintings 62 and 64 mounted therein in the same manner. Of course, the paintings 56, 62 and 64 may be replaced by photographs or other decorative panels, as desired.

The bores 32 in each set of bores 32 spaced along each of the peripheral members of the frames 10, 12 and 14 are spaced apart the same distance. Accordingly, the bores 32 of one frame may be registered with bores 32 of an adjacent frame. Further, the spacing of the bores 32 from the outer peripheral edges of each of the frames 10, 12 and 14 is equal to one half the distance between adjacent bores in each set of bores of the frames 10, 12 and 14. Threfore, when the frames 10, 12 and 14 are disposed in side by side contacting relation in the manner illustrated in FIG. 1 of the drawings the distance between registered bores of adjacent frames is the same as the distance between adjacent bores on each of the frames.

Figure 5:
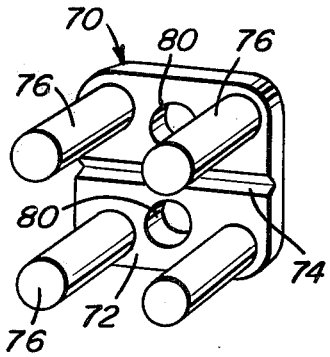
FIG. 5 is a perspective view of one of the mounting structures utilized in securing the frames to the wall.

With attention now invited more specifically to FIG. 5 of the drawings, there may be seen a connecting member referred to in general by the reference numeral 70. The connecting member 70 comprises a panel member 72 having front and rear sides and each panel member 72 includes a central weakened zone 74 extending thereacross along which the panel member 72 may be bent back and forth to separate the panel member 72 into two half panel members. Each of the portions of the panel member 72 disposed on opposite sides of the weakened zone 74 includes a pair of cylindrical projections 76 projecting outwardly of the front side of the panel member 72 and corresponding projections 76 of the portions of the panel member 72 disposed on opposite sides of the weakened zone 74 are spaced apart the same distance as the spacing between the projections 76 on the same side of the weakened zone 74. Furthermore, the spacing between the projections 76 on the panel member 72 is equal to the spacing between adjacent recesses or blind bores 32. Still further, each panel member half includes an aperture 80 formed therethrough by which the panel member half or the entire panel member 72 may be secured to the wall 82 by means of a fastener 84 secured through the aperture 80.

Figure 2:
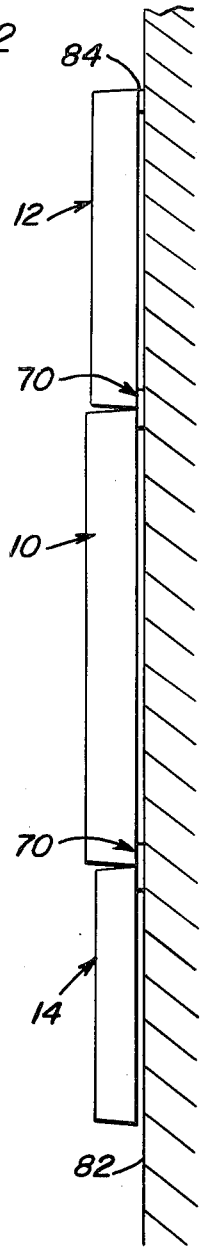
FIG. 2 is an enlarged side elevational view of the assemblage illustrated in FIG. 1 as seen from the right side thereof and with the associated wall structure illustrated in vertical section.

With attention now invited more specifically to FIG. 2 of the drawings, the upper horizontal member 38 of the frame 12 is secured to the wall 82 by a one-half panel member of one of the mounting members 70 as at 84 and with the projections 76 of that half panel member frictionally removably telescoped in the central pair of blind bores 32 formed in the upper horizontal member 38 of the frame 12. In addition, the frame 10 is supported from the frame 12 by means of a mounting member 70 having its upper pair of projections 76 removably telescoped in the bores 32 formed in the central bosses 42 on the lower horizontal member 40 of the frame 12 and its lower projections 76 removably telescoped in the bores 32 defined by the bosses 28 at one end portion of the upper horizontal member 16 of the frame 10. Still further, the lower frame 14 is supported from the frame 10 in a similar manner. Of course, each of the mounting members 70 interconnected between the frames 10 and 12 and the frames 10 and 14 may be secured to the wall 82 by means of one of the fasteners 84. In addition, the center portion of the upper horizontal member 16 of the frame 10 is anchored relative to the wall 82 by means of one of the fasteners 84 secured through a lower panel member half having its projections 76 received in the bores 32 defined by the bosses 26 carried by the upper horizontal member 16 of the frame 10.

It will be noted from FIGS. 1, 2, 3 and 4 of the drawings that the adjacent horizontal members of the frames 10, 12 and 14 are disposed in surface to surface contacting relation. Accordingly, the entire grouping of the three frames 10, 12 and 14 could be directly secured to the wall 82 merely by the utilization of a single fastener such as the fastener 84 illustrated in FIG. 3. In such instance, the lower frame 14 would be supported solely from the frame 10 and the upper frame 12 would be supported solely from the frame 10 by means of the associated mounting structure 70. However, in order to accomplish the mounting of the entire assemblage of the frames 10, 12 and 14 from the wall 82 by means of a single fastener requires that the grouping of frames 10, 12 and 14 be balanced relative to the single fastener.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination, a plurality of different size mounting frames each defined by at least three elongated interconnected straight sides having front and rear faces, each side of each of said frames including means defining first and second pairs of opposite end cylindrical recesses opening outwardly of the rear face thereof as well as at least one pair of intermediate cylindrical recesses opening outwardly of the longitudinal midportion thereof, the recesses of each pair of recesses being spaced apart the same distance along the corresponding frame side and spaced equally from the outer edge thereof, the juncture between adjacent sides of each frame defining a corner portion thereof and each corner portion including one of said recesses comprising the endmost recess of the corresponding pair of end recesses of the adjacent sides, at least two connecting members each comprising a body member having front and rear faces, said body members each including two laterally spaced pairs of spaced cylindrical projections projecting outwardly from the front face thereof, said frames being disposed in side by side substantially coplanar relation with opposing sides thereof disposed in juxtaposition, one of said body members being positioned with its front side closely opposing and bridging the rear faces of said opposing sides and with the projections thereof removably frictionally telescoped into laterally registered pairs of recesses of said opposing sides, and said connecting member thereby retaining said opposing sides of said frames against lateral separation and against relative longitudinal shifting, the pairs of projections on each body member are disposed in parallel rows of projections and the body member includes a weakened zone thereof paralleling and spaced generally equally between said rows of projections along which said body member may be separated into individual pieces thereof each including one pair of projections, each of said body member pieces including an aperture formed therethrough intermediate the projections supported therefrom.

2. The combination of claim 1 wherein each side of each frame defines an elongated channel member opening outwardly of the rear face thereof, each recess being defined by an outwardly opening socket formed in an integral boss portion disposed in the corresponding channel.

3. The combination of claim 1 wherein said frames are of one-piece molded construction.

4. The combination of claim 3 wherein said connecting members are of one-piece molded construction.

* * * * *